US005495385A

United States Patent [19]

Hsiu

[11] Patent Number: 5,495,385

[45] Date of Patent: Feb. 27, 1996

[54] FULLY AUTOMATIC, PHOTOSENSOR-CONTROLLED TIME SWITCH DEVICE

[76]. Inventor: Peng H. Hsiu, No. 181, Kuang-Ming Rd., Erh-Chung Li, Chu-Tung Town, Hsinchu Hsien, Taiwan

[21] Appl. No.: 116,525

[22] Filed: Sep. 7, 1993

[51] Int. Cl.[6] ..... H01H 47/24

[52] U.S. Cl. ..... 361/175

[58] Field of Search ..... 361/173–177; 307/117

[56] References Cited

U.S. PATENT DOCUMENTS 3,337,778 8/1967 Becker ..... 361/175 X
3,673,413 6/1972 Lee ..... 361/173 X
3,961,180 6/1976 Schultz ..... 361/173 X
3,993,569 11/1976 Zinsmeyer et al. ..... 361/176 X
3,995,202 11/1976 Powers ..... 361/173
4,095,100 6/1978 Selick ..... 361/173 X

*Primary Examiner*—Todd DeBoer
*Assistant Examiner*—Fritz M. Fleming

[57] ABSTRACT

A fully automatic, photosensor-controlled time switch device, which includes a control box having an input port connected to power supply and an output port for connecting the load to be controlled, and a control circuit installed inside the control box and connected between the input port and the output port, the control box consisted of a photosensor, a set of relays, a multiple contact switch, a time control switch, and a load switch for controlling the operation of the load automatically at a predetermined time period.

1 Claim, 4 Drawing Sheets

FULLY AUTOMATIC, PHOTOSENSOR-CONTROLLED TIME SWITCH DEVICE

BACKGROUND OF THE INVENTION

The present invention relates to a fully automatic, photosensor-controlled time switch device controlled by a photosensor and a multiple contact switch to fully automatically control the operation or the load according to the setting of a time control switch thereof. The device is practical for use to control the operation of neon lights, illuminators, electric water sprayers, water pumps, etc. It saves much power consumption and extends the service life of the loads.

Various electric appliances, for example: neon lights, illuminators, electric water sprayers, water pumps, etc. may be used daily at a fixed time period. Because these electric appliances are controlled manually, people may forget to turn on/off the switch timely. In case of a power failure, these electric appliances must be turned on again manually. It an electric appliance keeps operating for an extended length or time frequently, much power supply will be wasted, and the service life of the electric appliance will be shortened greatly.

SUMMARY OF THE INVENTION

The present invention has been accomplished under the aforesaid circumstances. It is therefore the principal object of the present invention to provide a time switch connected between power supply and the load, which automatically controls the operation of the load by means of the control of a photosensor and a set of relays to fully automatically control the operation of the load according to the setting of a time control switch thereof. It is another object of the present invention to provide a fully automatic, photosensor-controlled time switch which greatly saves power consumption. It is still another object of the present invention to provide a fully automatic, photosensor-controlled time switch which greatly extends the service life of the load. It is still another object of the present invention to provide a fully automatic, photosensor-controlled time switch which automatically returns to normal after a power failure without through any manual operation.

DETAILED DESCRIPTION OF THE PREFERRED EMBODIMENT

Figure 1:
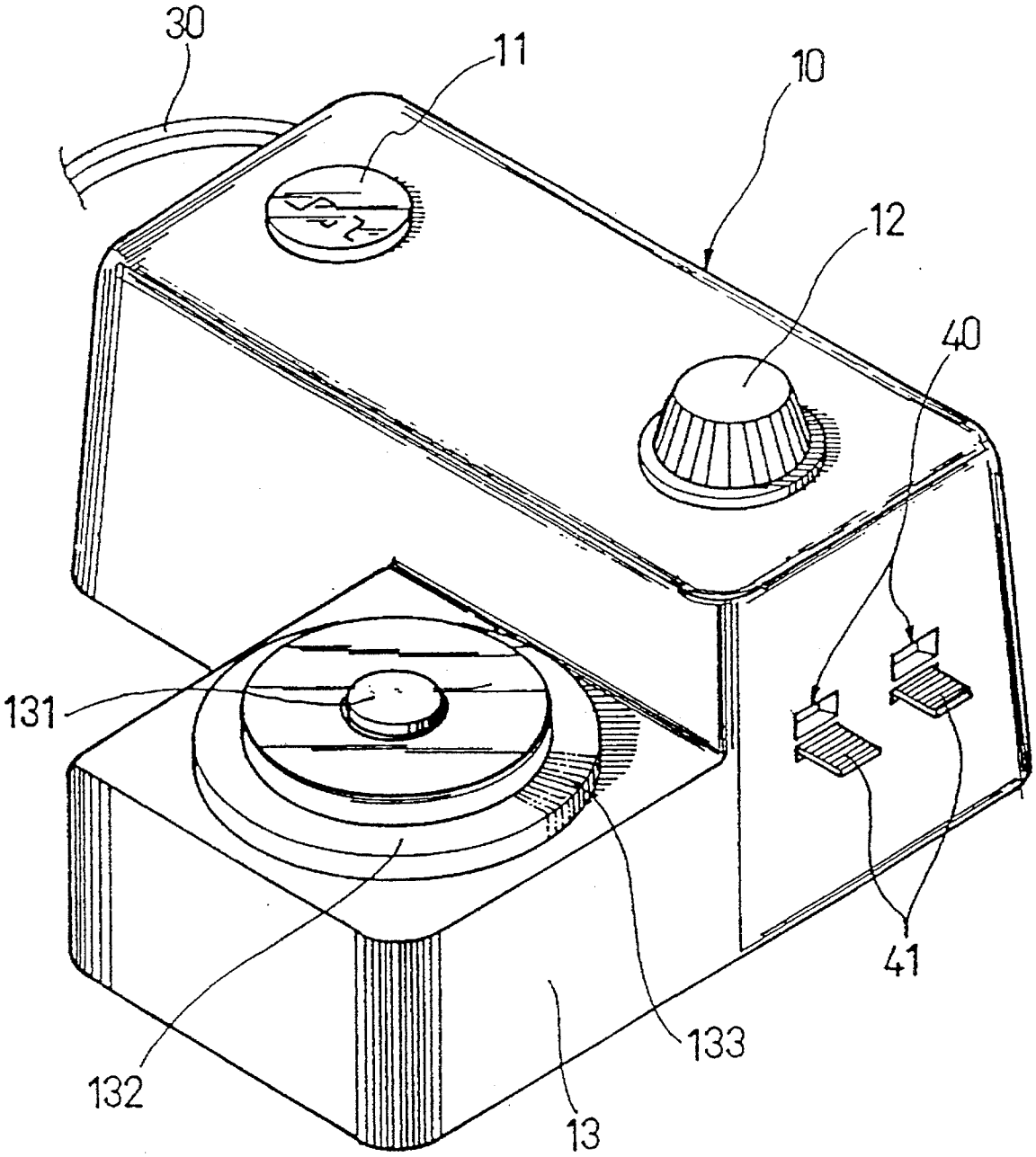
FIG. 1 is a perspective view of a fully automatic, photosensor-controlled time switch device embodying the present invention.

Referring to FIG. 1, the present invention comprises of a control box 10 made in a substantially rectangular configuration, a control circuit 20 installed inside the control box 10, a power cord 30 connected to one shorter side of the control box 10 for power input, and a plurality of output sockets 40 with fastening clamps 41 made on the opposite shorter side of the control box 10 for connecting the power cord of the electric appliances to be controlled. The control box 10 comprises a transparent cap 11 on the top above a photosensor 22, (not shown), a knob 12 spaced from the transparent cap 11 and turned to control a multiple contact switch 28 (not shown). A time control device 13 is a conventional device for controlling the circuit on/off at a fixed time period and is fastened to the control box 10 at one longer side thereof for the setting of a time control switch 23 (not shown), comprised of a time control disk 132 at the top, a time control push-button 131 in the center of the time control disk 132, and a plurality of time control keys 133 around the time control disk 132.

Figure 2:
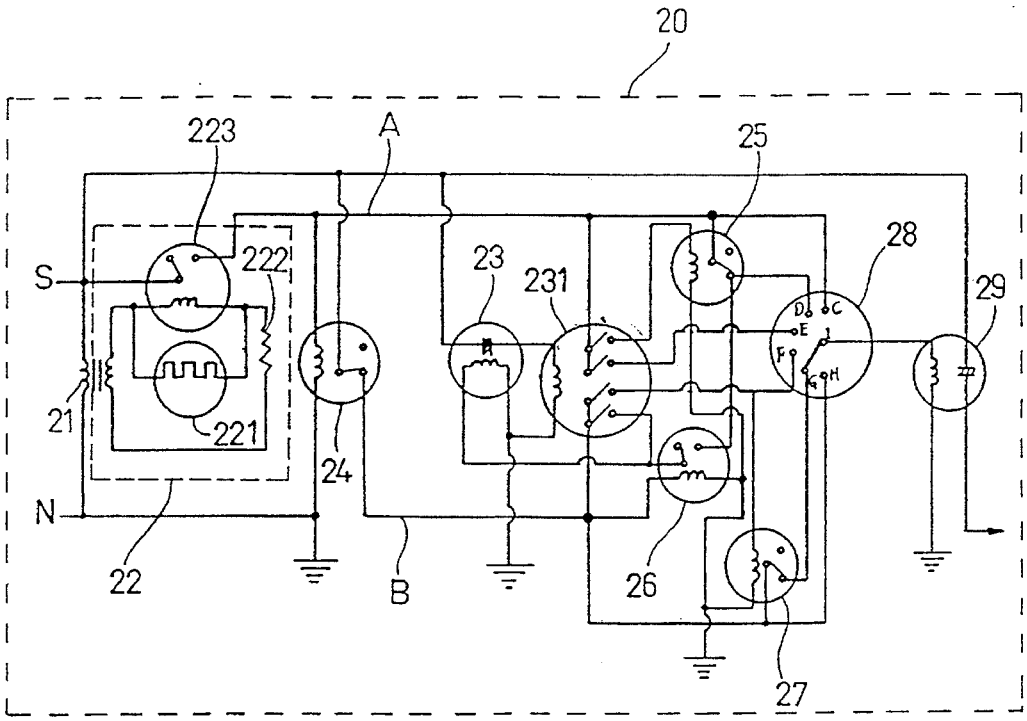
FIG. 2 is a circuit diagram of a control the time period of the second half of night.

Referring to FIG. 2, the control circuit 20 which is installed inside the control box 10 is connected to S and N contacts of the power cord 30, comprising a transformer 21 to regulate the input voltage, a photosensor 22 disposed below the aforesaid transparent cap 11 and connected to the transformer 21 and consisted of a photoresister 221 and a resistor 222, the photoresister 221 and the resistor 222 being connected in series, a first relay 223 and a second relay 24 respectively controlled by the photoresister 221 according to the intensity of light and formed into a day control line A or a night control line B alternatively, a fourth relay 25 respectively controlled by the day control line A, a fifth relay 26 and a sixth relay 27 respectively controlled by the night control line B, a multiple contact switch 28 connected to the third, fourth, fifth, and sixth relays 231;25;26;27 and controlled by the aforesaid knob 12 for controlling the load switch 9.9 thereof (according to the setting of lull-day/ forenoon/afternoon/ first hale of night/ second half of night/ and full-night time periods C, D, E, F, G and H).

If the multiple contact switch 28 is set by the knob 12 to turn on the load switch 29 at the second half of night, the operation of the control circuit 20 is explained hereinafter. During the night, the photoresister 221 of the photosensor 22 is turned to a high impedance status to stop electric current from passing through, and the first relay 223 does no work, therefore the second relay 24 becomes normally closed, and power supply is connected to the second relay 24 to provide a night control line B to the sixth relay for allowing power supply to be sent to the time period G and common contact I of the multiple contact switch 28 so as to turn on the load switch 29. At the same time, the contact of the time control switch 23 to power supply S contact is setting closed, causing the third relay 231 opened, however the time control switch does no any switching work i.e., the time control switch 23 is in an off position and no any switching work of circuit on/off by means of time control device 13.

Figure 2A:
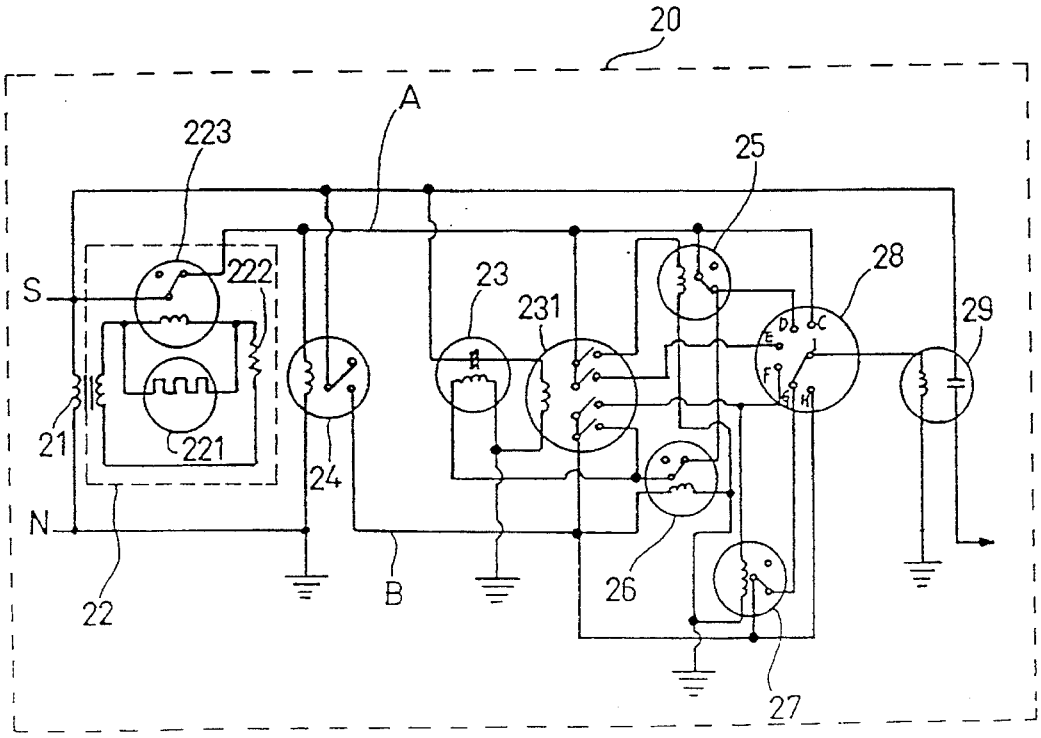
FIG. 2A shows another example of application of the control circuit set at the time period of the second half of night.

Referring to FIG. 2A, as the intensity of light is gradually turning from darkness to brightness, namely, when it begins to grow light:, the impedance of the photoresister 221 is reducing to let electric current pass through. As sufficient electric current passes through the photoresister 221, the first relay 223 becomes normally closed, and the second relay 24 becomes normally opened, and therefore the night control line B stops from sending electric current to the load switch 29. After one day-and-night, as the photoresister 221 is turned to the high impedance status again i.e., as the night coming again, the load switch 29 will be turned on again. However, as power supply is connected to the fourth relay 25 of the day control line A, the fourth relay 25 becomes normally closed, and therefore the fifth relay 26 becomes normally closed too. As the fifth relay 26 becomes at the normally closed status, the time control switch 23 starts counting by means of the timer of time control device 13 for a switching control. As indicated, the time control switch 23 is controlled by the time control device 13 to make a switching operation according to a pre-set length of time. The push-button 131 of the time control device 13 is used as the master power switch of the present invention, and the time control Keys 133 are for changing the setting of the switching time period are for controlling the interval of switching work of circuit on/off. For example, the switching operation will be repeated four times a day when a six-hour switching time period is set (the length of the switching time period must be a number that can divide the twenty four hours of a day with no remainder), i.e. to turn on the load switch 29 at forenoon and the first half of night and to turn off the load switch 29 at afternoon and the second half of night it makes use of conventional time control device 13 for fixed timer period controlling and conventional time control switch 23 for fixed time period switching on/off. In case of power failure, the shorter the switching time period, the longer the time for re-start. However, it can be turned to normal by switching the pre-set switching time period.

Figure 3:
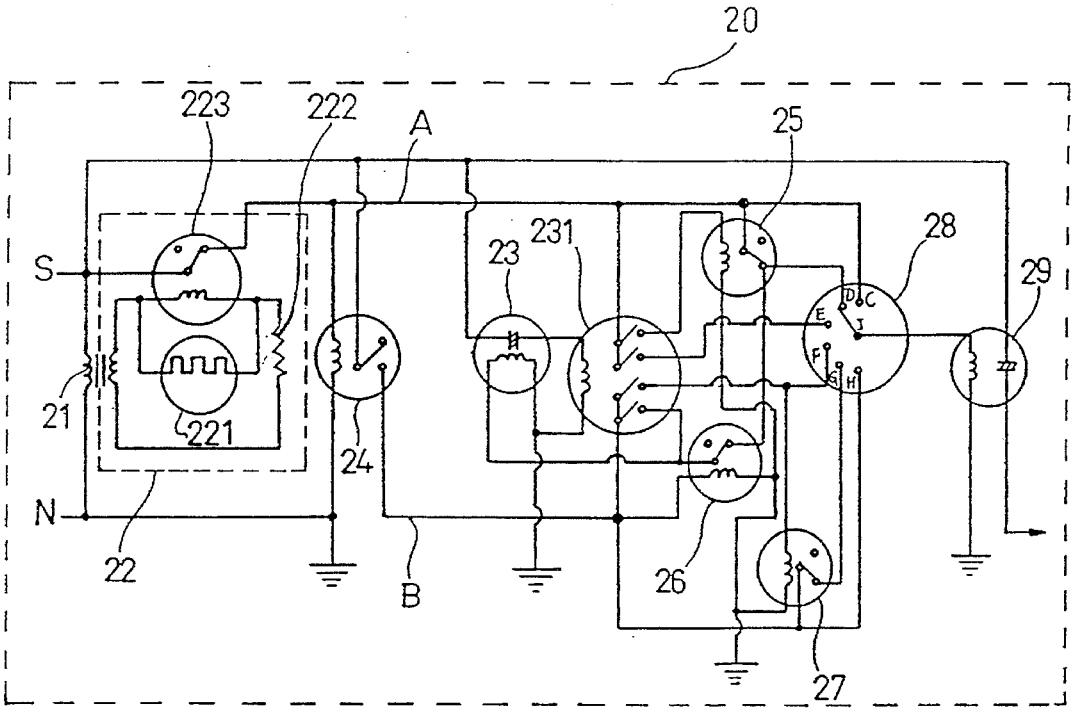
FIG. 3 shows the control circuit set at the time period of day.

Referring to FIG. 3, if the load is set to start operating at forenoon, the photosensor 22 drives the first relay 223 to let electric current pass through the day control line A, therefore the third relay 231 forms into an open circuit contact, and the fourth relay 25 is normally closed, through the fifth relay 26, causing the fifth relay 26 to turn on the time control switch 23 is turned on. As the time control switch 23 is turned on, the time period contact D and the common contact I are electrically connected to turn on the load switch 29. As the switching time period is terminated, the time control switch 23 is turned into the open circuit status, therefore the third relay 231 becomes normally closed, and the fourth relay 25 forms into an open circuit contact to turn of the load switch 29 (see also FIG. 4). In case of power failure, it is not necessary to reset the setting. The device will return to normal by counting the switching time period set by the time control keys 133, namely, by switching the time control switch 23 once.

Figure 4:
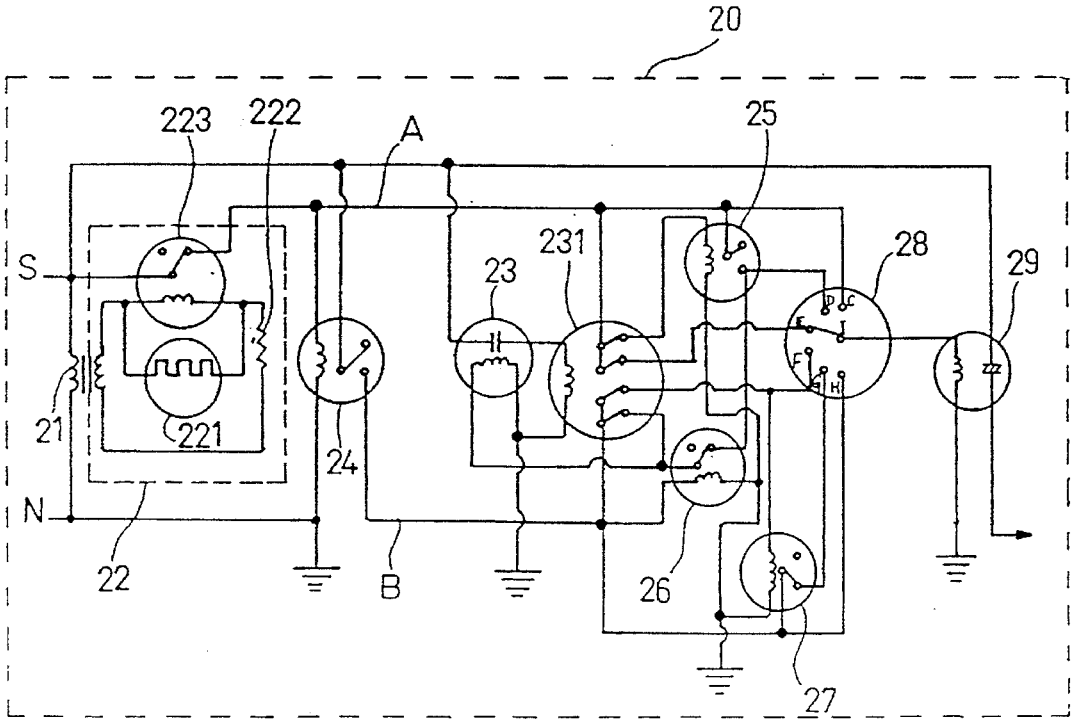
FIG. 4 shows the control circuit set at the time period of afternoon.

Referring to FIG. 4, if the knob 12 is turned to the time period of afternoon, the day control line A starts to work at afternoon. As the day control line A starts to work, the time control switch 23 is turned into the open circuit status, the third relay 231 becomes normally closed and electrically connected to the time period contact E of the multiple contact switch 28, and therefore the load switch 29 is turned on. The load switch 29 will be turned off as the next switching time period of the time control switch 23 comes.

Figure 5:
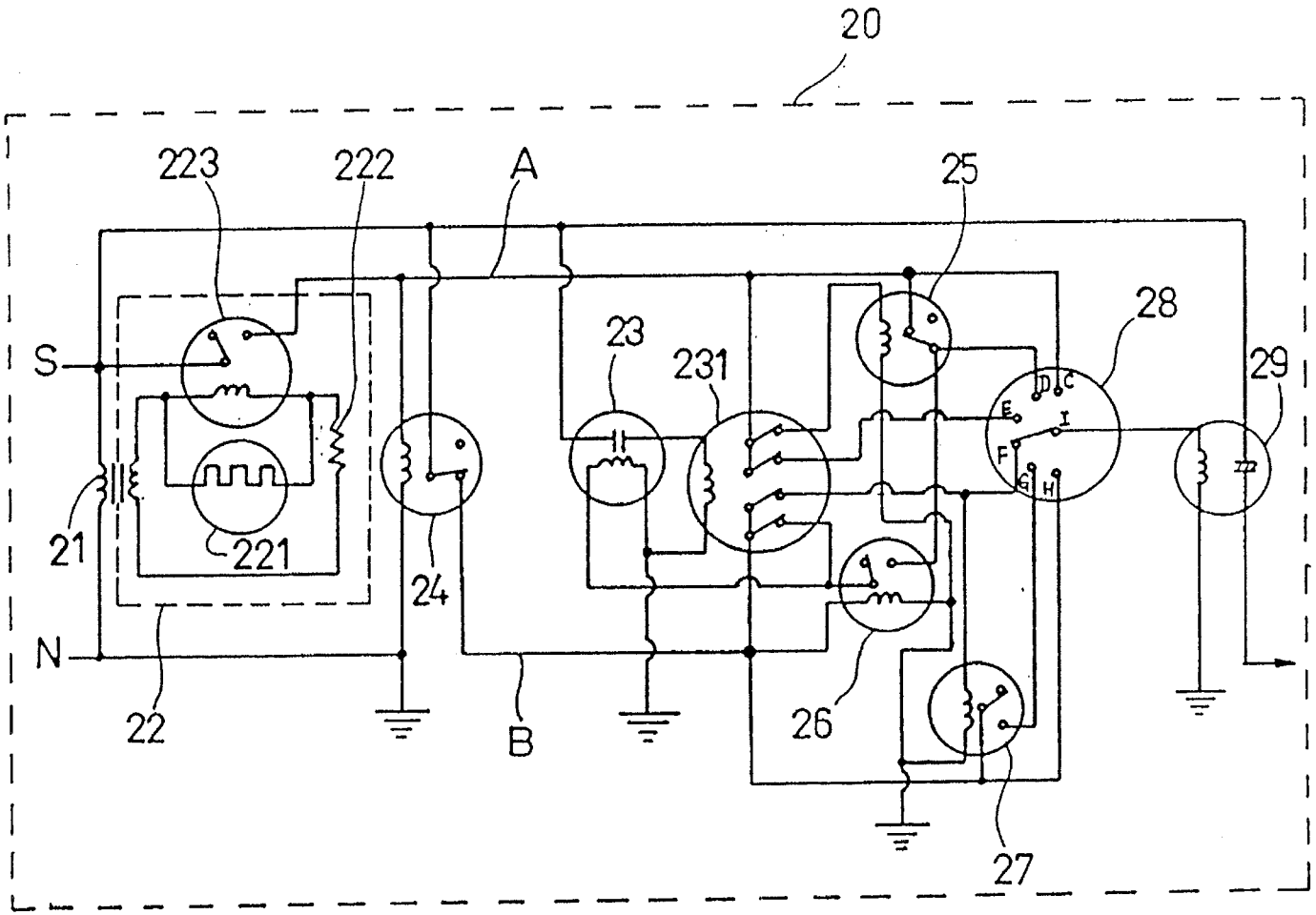
FIG. 5 shows the control .circuit set at the time period of night.

Referring to FIG. 5, if the knob 12 is turned to the time period of the first half of night, the day control line A will be turned into the night control line B as the first relay 223 is normally opened when the impedance of the photoresister 221 is increased. As the first relay 223 is normally opened, the time control switch 23 becomes normally opened, and electric current is sent through the third relay 231 to the time period contact F and common contact I of the multiple contact switch 28, therefore the load switch is automatically turned on at the first half of night.

As indicated, the present invention provides a fully automatic, photosensor-controlled time switch device for automatically controlling the load connected to the load switch thereof by means of the operation of a photosensor and the setting of a time control switch.

While only one embodiment of the present invention has been shown and described, it will be understood that various modifications and changes could be made thereunto without departing from the spirit and scope or the invention.

What is claimed is:

1. A fully automatic, photosensor controlled time switch device comprising a substantially rectangular control box having an input port connected to power supply by a power cord thereof and at least one output port for connecting the load, and a control circuit installed inside said control box and connected between said input port and said output port, said control circuit comprising a photosensor disposed below a transparent cap on said control box and consisted of a photoresister connected in series to a resistor, a time control switch connected to said power input port and set by a conventional time control device connected to said control box, a first relay and a second relay respectively controlled by said photosensor when day or night comes and formed into a day control line and a night control line respectively, a third relay controlled by the time control switch, a fourth relay controlled by said day control line, a fifth relay and a sixth relay controlled by said night control line, said fifth relay and said sixth relay controlled via said third relay, and a multiple contact switch having a common contact connected to a load switch thereof and a plurality of time period contacts respectively connected to said first, second, third, fourth, fifth, and sixth relays and controlled by a rotary knob mounted on said control box to connect said first, second, third, fourth, fifth, and sixth relays to said common contact alternatively so as to control the operation of the load via said load switch.

* * * * *